US005140877A

United States Patent [19]

Sloan

[11] Patent Number: 5,140,877

[45] Date of Patent: Aug. 25, 1992

[54] HEXAGONAL WRENCH

[76] Inventor: John Sloan, 1348 Campbell Ave., Chicago Hts., Ill. 60411

[21] Appl. No.: 829,536

[22] Filed: Feb. 3, 1992

Related U.S. Application Data

[62] Division of Ser. No. 627,451, Dec. 14, 1990, abandoned.

[51] Int. Cl.[5] ..... B25B 15/00

[52] U.S. Cl. ..... 81/439; 81/436

[58] Field of Search ..... 81/436–439, 81/461

[56] References Cited

U.S. PATENT DOCUMENTS

| | | | |
|---|---|---|---|
| 2,323,018 | 6/1943 | DeVellier | 81/436 |
| 2,605,665 | 8/1952 | Grenat | 81/125.1 |
| 2,643,566 | 6/1953 | Dos Santos et al. | 81/437 |
| 2,662,437 | 12/1953 | Reynolds | 81/125.1 |
| 3,376,768 | 4/1968 | Fortunato | 81/439 X |
| 4,246,811 | 1/1981 | Bondhus et al. | 81/436 |
| 4,566,357 | 1/1986 | Carossino | 81/436 X |
| 4,817,475 | 4/1989 | kelly et al. | 81/124.4 X |
| 4,819,521 | 4/1989 | Lang | 81/177.1 X |

FOREIGN PATENT DOCUMENTS

| | | | |
|---|---|---|---|
| 516506 | 12/1920 | France | 81/177.6 |

*Primary Examiner*—D. S. Meislin

*Attorney, Agent, or Firm*—Sughrue, Mion, Zinn, Macpeak & Seas

[57] ABSTRACT

A hexagonal wrench is provided with three equally spaced grooves of varying depth adjacent an end of the wrench to define three flat side ball-shaped members, the end ball of which is adapted to be inserted in a complementary hexagonal socket of a screw-threaded member. The grooves vary successively in depth with the groove furthest from the end being the shallowest groove so as to provide increased resistance to breakage. A modified hexagonal wrench is comprised of a stub shank of hexagonal cross-sectional configuration secured to an end of a flat elongated strip to facilitate operation of the wrench in areas of small clearance.

3 Claims, 2 Drawing Sheets

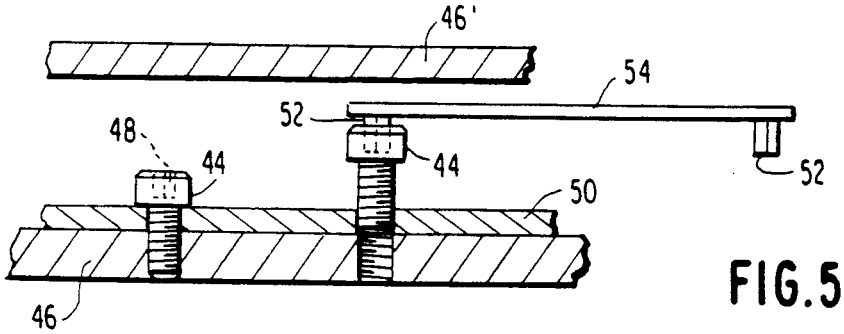
FIG.5
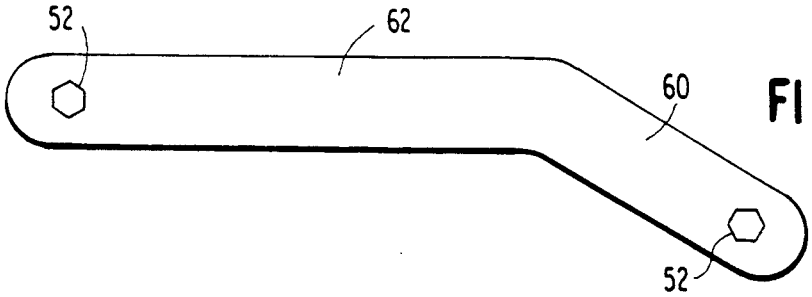
FIG.6
FIG.7
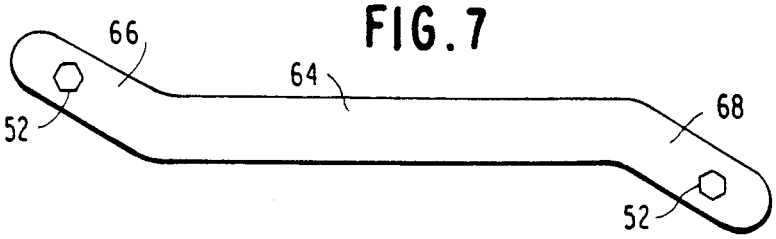
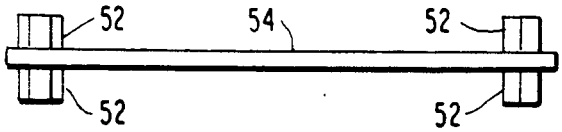
FIG.8
FIG.9
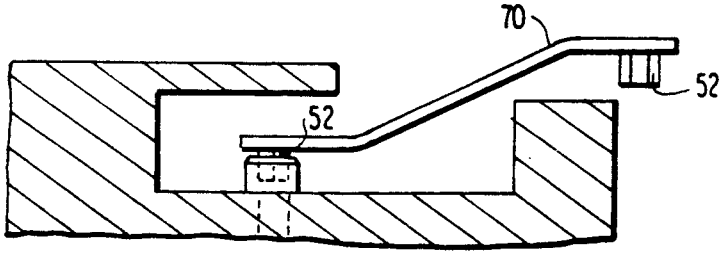

HEXAGONAL WRENCH

This is a divisional of application Ser. No. 07/627,451 filed Dec. 14, 1990.

BACKGROUND OF THE INVENTION

The present invention is directed to a hexagonal wrench and more specifically to a hexagonal wrench having a plurality of equally spaced apart circumferential grooves adjacent an end of the wrench to define a plurality of flat sided balls adapted to be inserted in hexagonal sockets at an angle for the angular application of a turning torque to the member containing the hexagonal socket.

Hexagonal wrenches are old and well-known in the art and such wrenches are generally known as ALLEN wrenches. Such wrenches have a hexagonal cross-sectional configuration and are generally L-shaped with one leg being substantially longer than the other to facilitate the application of a turning torque when either end of the wrench is inserted into a complementary hexagonal socket.

It is also known in the art to form a single circumferential groove spaced from the end of the wrench to define a flat-sided ball member adapted to be inserted in a hexagonal socket to facilitate the application of torque at an angle since ordinary hexagonal wrenches must be inserted with the longitudinal axis of the wrench aligned with the longitudinal axis of the socket. However, in order to obtain an effective angular application of torque, the depth of the groove must be fairly substantial thereby creating an inherent weakness in the hexagonal wrench. Accordingly, the ball will frequently snap off upon the application of excessive torque.

SUMMARY OF THE INVENTION

The present invention provides a new and improved hexagonal wrench having a plurality of equally spaced grooves formed adjacent an end of the hexagonal wrench to define a plurality of flat sided ball members. The groove closest to the end of the wrench has the deepest or optimum depth while the succeeding grooves away from the end of the wrench are progressively more shallow to provide increased strength for the application of a turning torque even though the presence of a groove provides a certain degree of weakening as compared to the strength of a hexagonal wrench without any grooves. The present invention provides a new and improved hexagonal wrench which is completely straight with a plurality of balls formed at opposite ends of the straight wrench and an adjustable handle may be clamped on the intermediate portion of the wrench at any desired position between the balls adjacent the ends of the wrench to facilitate the application of a turning torque to the hexagonal wrench.

The present invention provides a new and improved hexagonal wrench utilizing a relatively short straight hexagonal stub secured to a flat elongated strip to facilitate the application of torque to a complementary screw disposed in a location having very limited clearance. Different size hexagonal stubs may be secured at opposite ends of the elongated flat strip and/or on opposite sides thereof. The elongated flat strip may be angled in the plane of the strip or bent transversely of the plane of the strip to facilitate the operation of the hexagonal wrench in difficult locations.

The foregoing and other objects, features and advantages of the present invention will be apparent from the following more particular description of the preferred embodiments of the invention as illustrated on the accompanying drawings.

BRIEF DESCRIPTION OF THE DRAWINGS

FIG. 5 is a side elevational view of a modified wrench having a flat elongated strip with stub portions of hexogonal wrenches at opposite ends thereof.

FIG. 6 is a plan view of a wrench similar to that shown in FIG. 5 with one end thereof angled relative to the other end.

FIG. 7 is a wrench similar to that shown in FIG. 6 with the ends bent in opposite directions. FIG. 8 is a wrench similar to that shown in FIG. 5 with hexagonal wrench stubs on opposite sides thereof.

FIG. 9 is a wrench similar to that shown in FIG. 6 but bent transversely to the plane of the wrench handle.

DETAILED DESCRIPTION OF THE INVENTION

Figure 1:
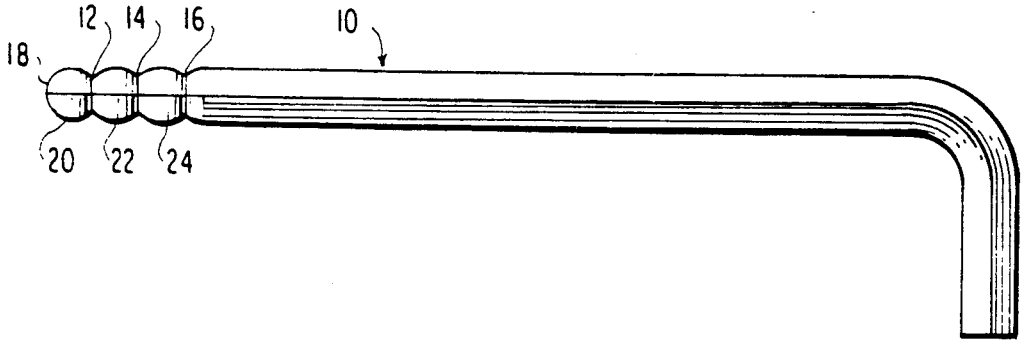
FIG. 1 is a plan view of an angled hexagonal wrench according to the present invention.
Figure 2:
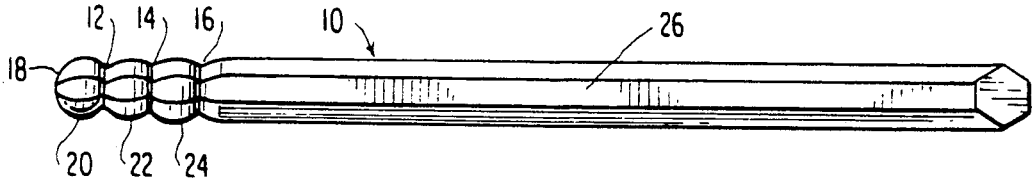
FIG. 2 is a side elevational view of the hexagonal wrench shown in FIG. 1.

The hexagonal wrench 10 as shown in FIGS. 1 and 2 is a standard conventional six-sided wrench having an L-shaped configuration. A plurality of equally spaced circumferentially extending grooves 12, 14 and 16 are formed adjacent the end of the longer leg of the L-shaped wrench. The groove 12 is the deepest groove, the groove 14 is of intermediate depth and the groove 16 is the shallowest groove. The end portion of the wrench is rounded at 18 and the surfaces of each side of the wrench are rounded in opposite directions from the deepest part of each groove so as to define three ball-shaped portions 20, 22 and 24. Thus, the ball 20 is adapted to be inserted in the hexagonal socket of a threaded member with the axis of the longest leg 26 disposed at an angle to axis of the threaded member to facilitate the application of torque to the threaded member in situations where the straight line application of torque would be difficult or impossible.

As mentioned previously, the use of a single ball on the end of a hexagonal wrench is old and well-known in the art. However, the depth of the groove forming the ball creates a weakness in the wrench and such ball members frequently snap off during the application of excessive torque. Should the end ball 20 as disclosed in FIGS. 1 and 2 of the present application snap off, the ball 22 is immediately available for use. The depth of the groove determines the degree at which the wrench may be angled relative to the axis of the threaded member having the hexagonal socket therein. Thus, the ball 22 can be used immediately but it is not possible to angle the wrench relative to the axis of the threaded member as much as when the ball 20 was being used. Thus, if it is desired angle the wrench to a greater degree when using the ball 22, it is only necessary to grind the groove 14 slightly deeper using a simple hand file or a power grinder. Should the ball 22 break off during use, the ball 24 will be immediately available for use either in its present form or with the groove 16 ground slightly deeper. As each ball breaks off, it may be also necessary to grind the new end of the wrench to provide a smooth-rounded surface. Any number of grooves can be initially provided on the wrench but three grooves has proven to be satisfactory. The flat hexagonal sides of the wrench still maintain their identity on each ball 20, 22 and 24 so as to impart driving torque when the ball is inserted in a complementary hexagonal socket.

Figure 3:
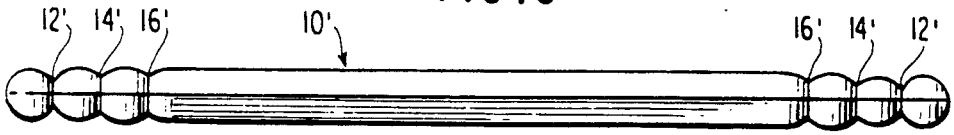
FIG. 3 is a plan view of a straight line hexagonal wrench having grooves at opposite ends thereof.

A modified form of a hexagonal wrench is shown in FIG. 3 wherein the hexagonal wrench is completely straight without any angled portion. Thus, a plurality of grooves 12', 14' and 16' can be provided at opposite ends of the wrench to define twice the number of balls which would be available for use. This is also true of the wrench shown in FIGS. 1 and 2.

Figure 4:
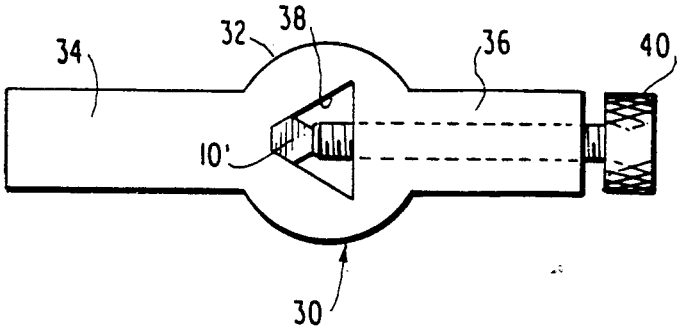
FIG. 4 is an end view of the wrench shown in FIG. 3 with the handle device secured thereon intermediate the ends of the wrench.

In order to impart turning torque to a wrench of the type shown in FIG. 3, an adjustable handle device 30 is shown in FIG. 4, which is adapted to be detachably clamped to an intermediate portion of the wrench. The wrench 30 is comprised of a central portion 32 having a pair of handles 34 and 36 protruding in opposite directions therefrom. An aperture 38 is formed through the central portion 32 defining a notch adapted to engage three sides of the wrench 10'. A clamping member 40 is threaded longitudinally through the handle portion 36 into engagement with a side of the wrench 10' for clamping the handle on the wrench.

A modified form of Allen wrench is shown in FIG. 5 which is suitable for use in places having extremely small clearances. A pair of screw threaded members 44 having hexagonal sockets 48 in the heads thereof are provided for securing a plate 50 to a support 46. Due to the presence of another support 46', the clearance between the support 46' and the plate 50 is so small that it is impossible to use a conventional hexagonal wrench. Even if the shorter leg of a conventional hexagonal wrench is ground down to make the leg extremely short, the extent to which the leg which may be ground is limited by the curvature between the two legs of the L-shaped wrench.

According to the present invention, a short length of hexagonal wrench 52 is welded to a flat elongated metal strip 5 adjacent an end thereof. The length of the hexagonal stub 52 is only as long as the standard depth of a hexagonal socket in a threaded member. Hexagonal stubs may be secured to opposite ends of the strip 54 as shown in FIG. 5 and may even be secured to opposite sides of the strip 54 as shown in FIG. 8. The hexagonal stubs may be butt-welded to the surface of the metal strip 54. However, it is preferable to punch an opening through the flat metal strip 54 having a configuration complementary to the hexagonal configuration of the hexagonal stub. The clearance between the stub and the aperture may be such that a force-fit can be achieved or the stub can be welded into the aperture to make certain the stub is securely fastened to the strip 54. The stub may protrude from one or both sides of the metal strip 54. Each of the stubs 52 shown in FIG. 8 can be of a different size to provide a more versatile wrench.

When the stubs 52 at opposite ends of the strip 54 are of the same size, it is best to rotate one stub relative to the other by an angle of 30°. Thus, in extremely close work areas which limit the turning angle, it is possible to merely reverse the wrench end for end on alternate turns to more easily engage the stub in a socket.

In order to facilitate the operation of the wrench shown in FIGS. 5 and 8 in unusual locations the end 60 of the strip 62 may be bent at an angle in the plane of the strip 62. In the embodiment of FIG. 7, the strip 64 is provided with oppositely bent end portions 66 and 68, both of which are bent in the plane of the strip 64. As shown in FIG. 9, the strip 70 may be bent transversely to the plane of the strip to facilitate the use of the wrench in unusual locations such as that illustrated in FIG. 9. The bend as shown in FIG. 9 may be permanent or the strip 70 may have sufficient flexibility to allow temporary bending of the strip during the application of torque with the strip returning t its original flat configuration subsequent to use. The foregoing examples of hexagonal wrenches according to the present invention have been provided to show the concept of the invention and many modifications can be made within the scope of the present invention. For example, the hexagonal stubs can be forged as a single one-piece member with a tempered shank portion which may be bendable if necessary. The hexagonal stubs may have different hexagonal configurations and any combination of sizes and shapes can be applied to the various types of strips as illustrated. The hexagonal stubs may even be provided with one or more balls as shown in FIGS. 1–3.

While the invention has been particularly shown and described with reference to the foregoing preferred embodiments, it will be understood by those in the art that the foregoing and other changes in form and details may be made therein without departing from the spirit and scope of the invention.

What is claimed is:

1. A hexagonal wrench comprising an elongated six-sided shank and a plurality of equally spaced grooves disposed adjacent one end of said shank to define a plurality of rounded portions of equal axial extent with said grooves successively decreasing in depth with the groove furthest from said end being the shallowest groove.

2. A hexagonal wrench as set forth in claim 1, further comprising an identical set of grooves and balls disposed adjacent an opposite end of said shank.

3. A hexagonal wrench as set forth in claim 2, further comprising detachable handle means adapted to be clamped to said shank intermediate the ends thereof to provide a gripping means for the application of turning torque to the wrench.

* * * * *